US009442424B2

(12) United States Patent
Fan et al.

(10) Patent No.: US 9,442,424 B2
(45) Date of Patent: Sep. 13, 2016

(54) DEVELOPING CARTRIDGE FOR LASER PRINTER COMPRISING A STIRRING WHEEL AND AN ACTIVATION MECHANISM

(71) Applicant: PRINT-RITE • UNICORN IMAGE PRODUCTS CO., LTD. OF ZHUHAI, Zhuhai (CN)

(72) Inventors: Wenyi Fan, Zhuhai (CN); Qile Wang, Zhuhai (CN)

(73) Assignee: PRINT-RITE · UNICORN IMAGE PRODUCTS CO., LTD. OF ZHUHAI (CN)

( * ) Notice: Subject to any disclaimer, the term of this patent is extended or adjusted under 35 U.S.C. 154(b) by 0 days.

(21) Appl. No.: 14/776,304

(22) PCT Filed: Dec. 23, 2013

(86) PCT No.: PCT/CN2013/090203

§ 371 (c)(1),
(2) Date: Sep. 14, 2015

(87) PCT Pub. No.: WO2014/139304

PCT Pub. Date: Sep. 18, 2014

(65) Prior Publication Data

US 2016/0041502 A1 Feb. 11, 2016

(30) Foreign Application Priority Data

Mar. 15, 2013 (CN) ..... 2013 1 0084229

(51) Int. Cl.
*G03G 15/00* (2006.01)
*G03G 15/08* (2006.01)
*G03G 21/16* (2006.01)

(52) U.S. Cl.
CPC ..... *G03G 15/0889* (2013.01); *G03G 15/0806* (2013.01); *G03G 21/1647* (2013.01); *G03G 2221/1657* (2013.01)

(58) Field of Classification Search
CPC ..... G03G 21/1803; G03G 21/1647; G03G 21/1676; G03G 21/1864; G03G 2221/163; G03G 2221/1892; G03G 2221/1657; G03G 15/0889; G03G 15/0806
See application file for complete search history.

(56) References Cited

U.S. PATENT DOCUMENTS 5,038,173 A * 8/1991 Kusumoto ..... G03G 21/1896 399/12
5,276,479 A * 1/1994 Inomata ..... G03G 15/01 399/112

(Continued)

FOREIGN PATENT DOCUMENTS

CN 1580971 A 2/2005
CN 200983078 Y 11/2007

(Continued)

OTHER PUBLICATIONS

International Search Report for Application No. PCT/CN2013/090203 dated Mar. 6, 2014.

*Primary Examiner* — David Gray
*Assistant Examiner* — Trevor J Bervik
(74) *Attorney, Agent, or Firm* — Lerner, David, Littenberg, Krumholz & Mentlik, LLP

(57) ABSTRACT

The present invention discloses a developing cartridge for a laser printer, comprising a stirring wheel and an activation mechanism, the activation mechanism comprising a diameter-changing wheel, a return spring and a sliding block, wherein the diameter-changing wheel is parallel with an axial direction of the stirring wheel and includes two sections of arcs, a larger diameter arc of the two sections of arcs is meshed with the stirring wheel, a protruding block is provided on a lateral end wall at a side of the axial direction of the diameter-changing wheel facing the end cover, a part of the end cover corresponding to the diameter-changing wheel is provided as an inclined wall, the inclined wall is provided with a sliding groove, the sliding block is mounted in the sliding groove, the return spring presses the sliding block in the sliding groove at one end close to the diameter-changing wheel.

6 Claims, 6 Drawing Sheets

(56) References Cited

U.S. PATENT DOCUMENTS

| | | | | |
|---|---|---|---|---|
| 7,991,322 | B2 * | 8/2011 | Ukai | G03G 21/1864 399/107 |
| 2005/0031359 | A1 | 2/2005 | Ishii | |
| 2006/0193645 | A1 * | 8/2006 | Kishi | G03G 21/1896 399/12 |
| 2008/0205928 | A1 * | 8/2008 | Ishikawa | G03G 15/0855 399/111 |
| 2009/0269085 | A1 | 10/2009 | Ukai | |
| 2011/0211864 | A1 | 9/2011 | Ishikawa | |
| 2012/0243882 | A1 * | 9/2012 | Carot | G03G 15/0863 399/12 |
| 2015/0086222 | A1 * | 3/2015 | Shimizu | G03G 21/1896 399/12 |

FOREIGN PATENT DOCUMENTS

| | | | |
|---|---|---|---|
| CN | 201097113 | Y | 8/2008 |
| CN | 101256382 | A | 9/2008 |
| CN | 101566808 | A | 10/2009 |
| CN | 103149816 | A | 6/2013 |
| JP | 2002169449 | A | 6/2002 |
| JP | 2008242085 | A | 10/2008 |

* cited by examiner

DEVELOPING CARTRIDGE FOR LASER PRINTER COMPRISING A STIRRING WHEEL AND AN ACTIVATION MECHANISM

CROSS-REFERENCE TO RELATED APPLICATIONS

This application claims the priority from international application No. PCT/CN2013/090203 filed on Dec. 23, 2013, which claims priority from Chinese patent application No. 201310084229.3 filed on Mar. 15, 2013. These applications are incorporated herein by reference.

TECHNICAL FIELD

The present invention relates to the electronic photographic imaging field, particularly to a developing cartridge for a laser printer.

BACKGROUND ARTS

The imaging process of a laser printer, which is composed of a process cartridge 100 as a basic core component, is shown in FIG. 1. The surface of a photosensitive drum 101 is evenly charged by a charging roller 102. A laser scanner 103 emits a modulated laser beam 104 containing image information to an outer cylindrical surface of the photosensitive drum 101. After illumination of the laser beam 104, a static charge distribution pattern with distribution difference, that is, an electrostatic latent image corresponding to the image to be copied, is formed on the cylindrical surface of the photosensitive drum 101. Then, a developer such as toner 106 transferred by a developing roller 105 is attracted to the cylindrical surface of the photosensitive drum 101 after the thickness thereof is regulated by a toner blade 113, covers the aforementioned electrostatic latent image and converts the same into a visual image which can be observed with naked eyes. As the photosensitive drum 101 rotates, the visual image formed by the toner 106 on the surface of the photosensitive drum is transferred to a position where a transfer roller 107 is located. Under the transfer voltage carried by the transfer roller 107, the toner in the form of the visual image is transferred to the surface of a recording medium 108 such as paper. After heated by a heating roller 111 and pressurized by a pressure roller 112, the toner in the form of the visual image on the recording medium 108 permeates into the fiber layers of the recording medium 108, curing the visual image formed by the toner on the recording medium 108 permanently. After the visual image on the photosensitive drum 101 is transferred by the transfer roller 107, residual toner 109 attached to the transfer roller 107 is scraped off by a waster toner blade 110 into a waster toner collecting tank. After static electricity on the surface of the photosensitive drum 101 is removed by a static electricity removing device, the photosensitive drum 101 is returned to the standby state, free from static electricity and toner. Then, a basic imaging workflow is finished. A desired image can be obtained by repeating the workflow.

For the above process cartridge 100, different manufacturers will produce products of different integration degrees in accordance with the functions and service lives of the components of the process cartridge 100, combined with their own R & D models. For example, the developing roller 105 responsible for developing and the toner blade 113 responsible for regulating the thickness of the toner layer may be integrated into an independent developing cartridge, which has the functions of storing a developer and transporting the same to the surface of the photosensitive drum 101. The photosensitive drum 101 may be pre-installed into the laser printer, or may be assembled with other components to form an electronic photographic imaging unit before being installed into the laser printer.

The document CN1580971 discloses a device for automatically detecting whether a developing cartridge mounted on an image forming apparatus has been used. The structure is a detection gear having a gear part with some missing teeth, and can irreversibly move from an unused position where the detection gear does not engage with the stirring rack gear, to a used position where the detection gear does not engage with the drive gear, through a drive force transmitting position where the detection gear engages with the drive gear, wherein the gear part engages with the detection gear when the detection gear is at the drive force transmitting position, the detection gear is provided with a contact member contacting a corresponding contacted member inside the machine, and when the developing cartridge is mounted to the image forming apparatus, a protrusion on the contact member contacts the contacted member to move the detection gear from the unused position to the drive force transmitting position.

TECHNICAL PROBLEM

Since the force receiving part of the gear of the detection mechanism, namely, the gear part, and the application force part, namely, the protrusion, are provided on the same detection gear, the detection gear becomes a vulnerable part, reducing the performance stability of the detection gear.

TECHNICAL SOLUTION

Aiming at the problem that the detection performance is not stable due to easy damages of the detection gear of the developing cartridge, the present invention aims to provide a developing cartridge for a laser printer with reliable performance when detecting whether the developing cartridge is a new product.

In order to achieve the above purpose of the invention, the invention has developed a developing cartridge for a laser printer. It includes: a stirring wheel that is configured to receive a torque and transfer the same to a stirring rack and that is enclosed on an outer wall of a tank of the developing cartridge by an end cover; and an activation mechanism, comprising a diameter-changing wheel, a return spring and a sliding block, wherein the diameter-changing wheel is parallel with an axial direction of the stirring wheel and includes two sections of arcs of different diameters and connected with each other in an end-to-end manner, the larger diameter arc of the two sections of arcs is meshed with the stirring wheel at one end along the circumferential direction thereof, a protruding block is provided to axially face the end cover extending from the diameter-changing wheel at a non-circle center position facing a lateral end wall of the end cover at an axial side of the diameter-changing wheel, a part of the end cover corresponding to the diameter-changing wheel is provided as a planar inclined wall in an inclined and intersecting relation with an axial direction of the diameter-changing wheel, the inclined wall is provided with a sliding groove having the same inclination as that of the inclined wall relative to the axial direction of the diameter-changing wheel, the sliding block is slidably mounted in the sliding groove, the return spring presses the sliding block in the sliding groove at one end close to the diameter-changing wheel, an end of the sliding block opposing the diameter-changing wheel is in a free hanging state, and the end of the sliding block close to the diameter-changing wheel is located in front of the protruding block which moves circularly following the diameter-changing wheel, and extends to a base portion where the protruding block is adjacent to the diameter-changing wheel in the axial direction of the diameter-changing wheel.

In the aforementioned developing cartridge for a laser printer, the circumferential surface of the larger diameter arc is covered with an elastic rubber ring, through which one end of the larger diameter arc is meshed with the stirring wheel along the circumferential direction of the larger diameter arc.

In the aforementioned developing cartridge for a laser printer, the return spring is fixed on an inner wall of the end cover facing the diameter-changing wheel.

In the aforementioned developing cartridge for a laser printer, the return spring is a torsion spring, whose one torsion arm presses the sliding block in the sliding groove at one end close to the diameter-changing wheel.

BENEFICIAL EFFECT

When detecting whether the developing cartridge is a new product via the activation mechanism of the laser printer, the developing cartridge for a laser printer of the present invention has reliable performance. Since the each component of the activation mechanism have a single function, their configuration is simple, thereby simplifying the production process and reducing the cost.

EMBODIMENT OF INVENTION

The developing cartridge for a laser printer of the present invention is described in detail with reference to the drawings.

FIGS. 2-12 respectively show the perspective views of the developing cartridge for a laser printer of the present invention from different perspectives and in different assembled states.

The main configuration manner of the developing cartridge for a laser printer of the present invention is substantially the same as that in the prior arts in the related field, and can be acquired by those skilled in the art with reference to the related technical documents and the Background Art part of this description. In view of this, the reference signs for the same members in the Background Art part of this description will be used for the members mentioned in the description of the embodiments of the developing cartridge for a laser printer of the present invention. In addition, since this invention intends to propose a solution for the problem that the detection performance of the existing developing cartridge is not stable due to easy damages of the detection gear when detecting whether the developing cartridge is a new product, the applicant will focus on the developing cartridge for a laser printer of the present invention and the part for detecting whether the developing cartridge is a new product via a laser printer.

Figure 1:
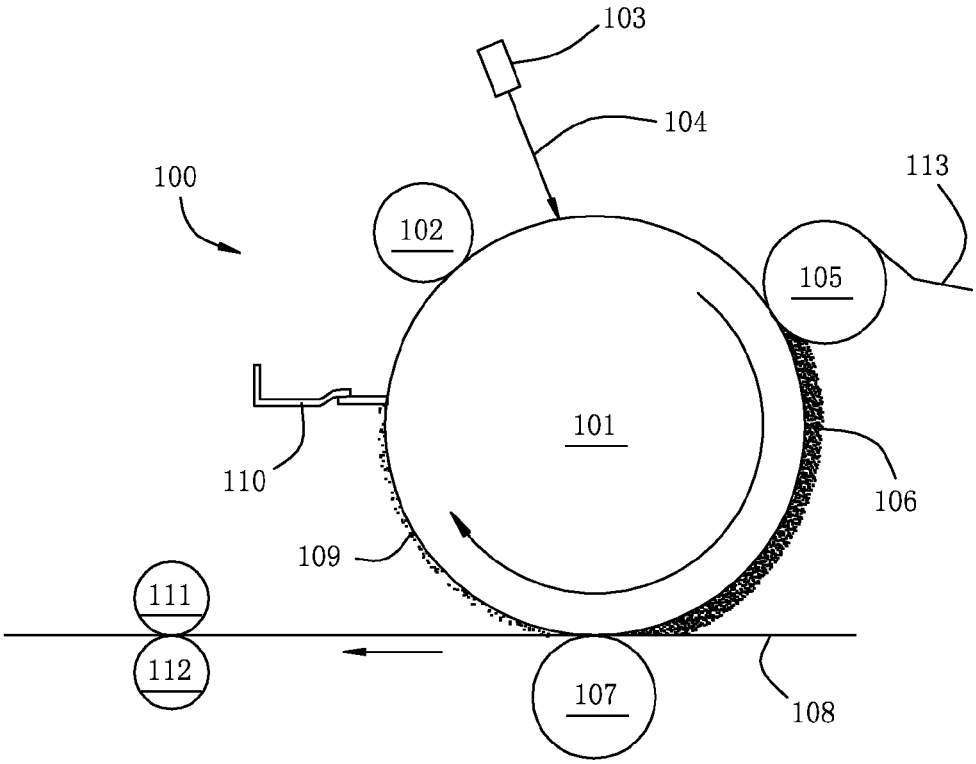
FIG. 1 is a working principle schematic diagram of an existing laser printer.
Figure 2:
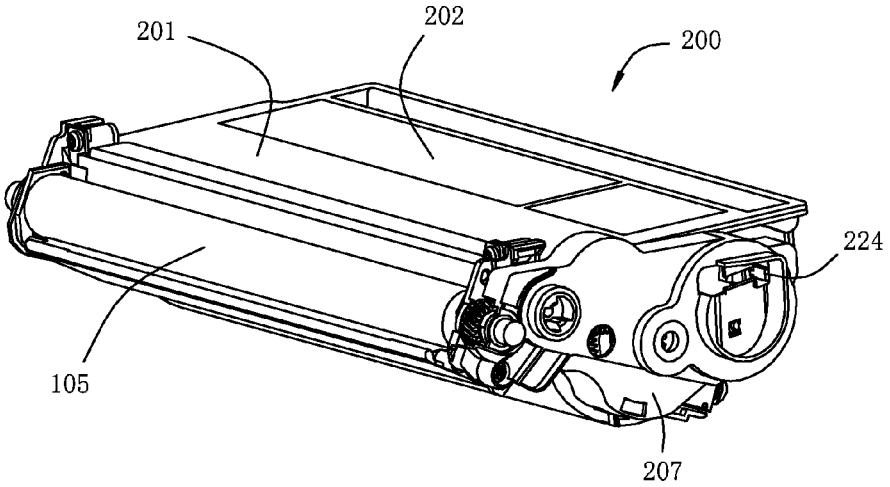
FIG. 2 is a perspective view of the developing cartridge for a laser printer of the present invention.
Figure 3:
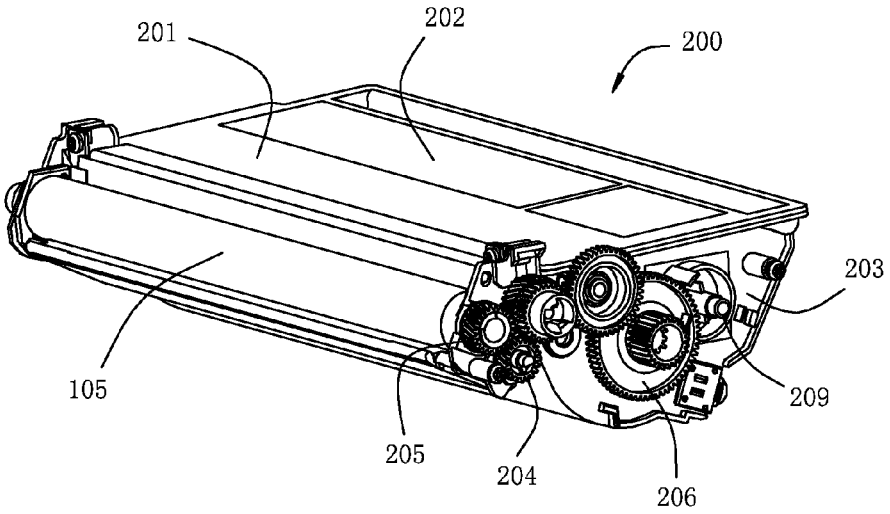
FIG. 3 is a perspective view of the developing cartridge for a laser printer of the present invention after the end cover is removed.
Figure 4:
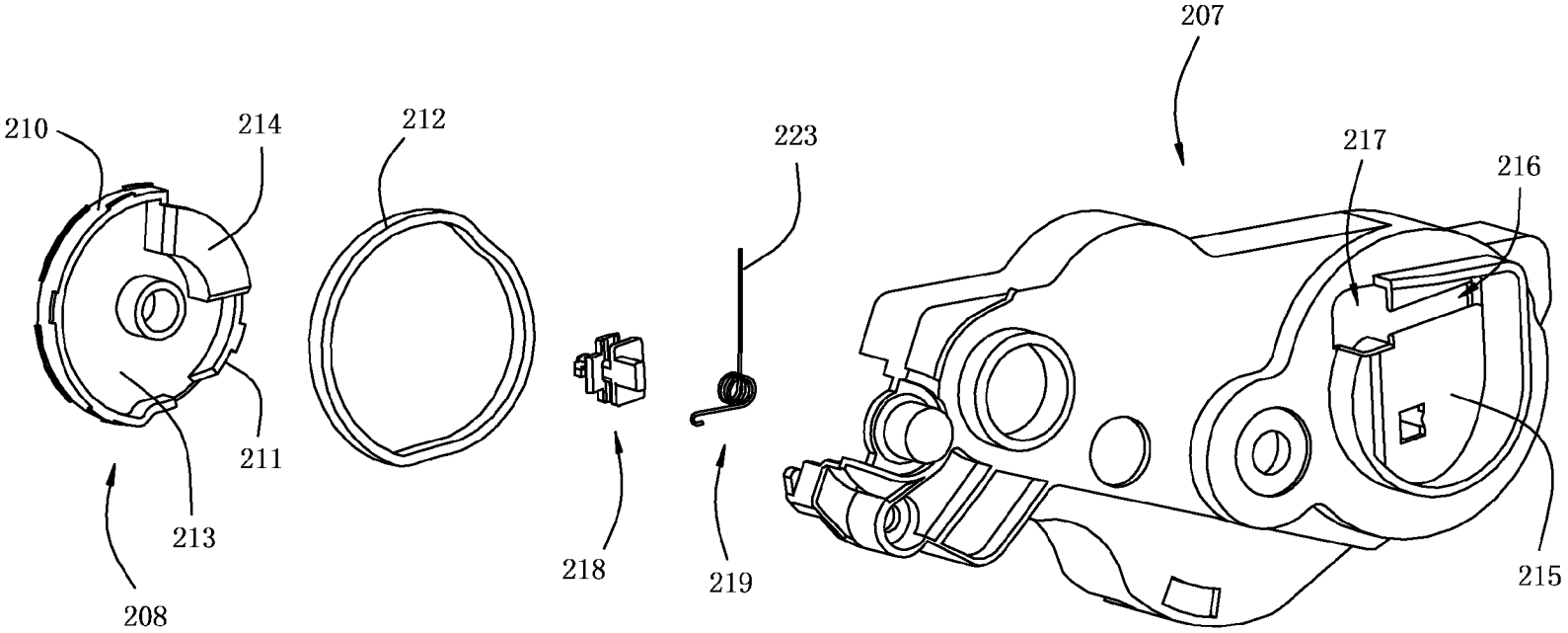
FIG. 4 is an exploded perspective view of the activation mechanism of the developing cartridge for a laser printer of the present invention.
Figure 5:
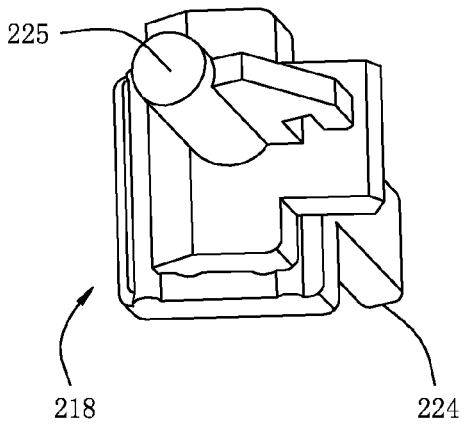
FIG. 5 is a perspective view of the sliding block of the developing cartridge for a laser printer of the present invention.
Figure 6:
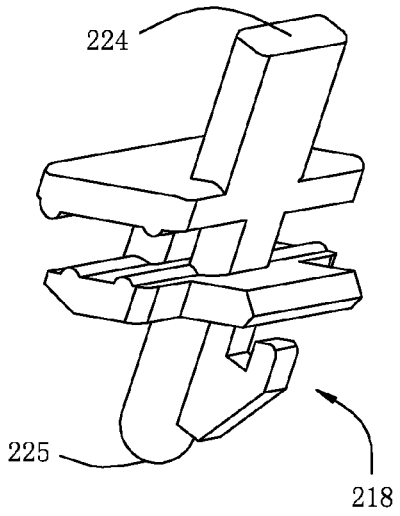
FIG. 6 is another perspective view of the sliding block of the developing cartridge for a laser printer of the present invention.
Figure 7:
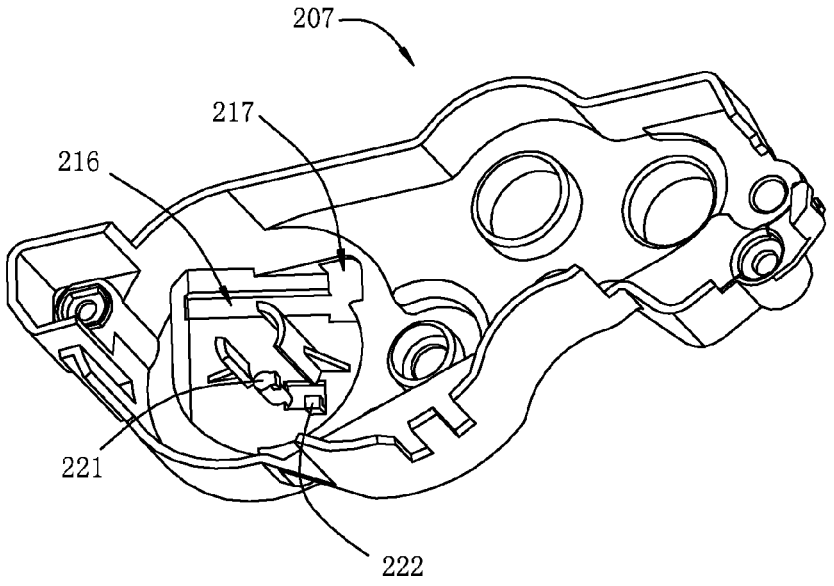
FIG. 7 is a perspective view of the end cover of the developing cartridge for a laser printer of the present invention.
Figure 8:
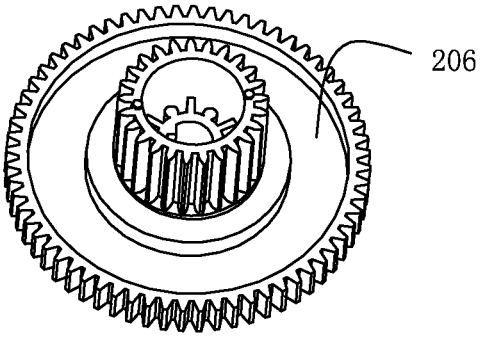
FIG. 8 is a perspective view of the stirring wheel of the developing cartridge for a laser printer of the present invention.
Figure 9:
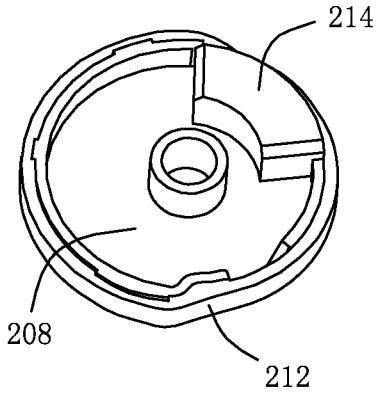
FIG. 9 is a perspective view of the diameter-changing wheel of the developing cartridge for a laser printer of the present invention.
Figure 10:
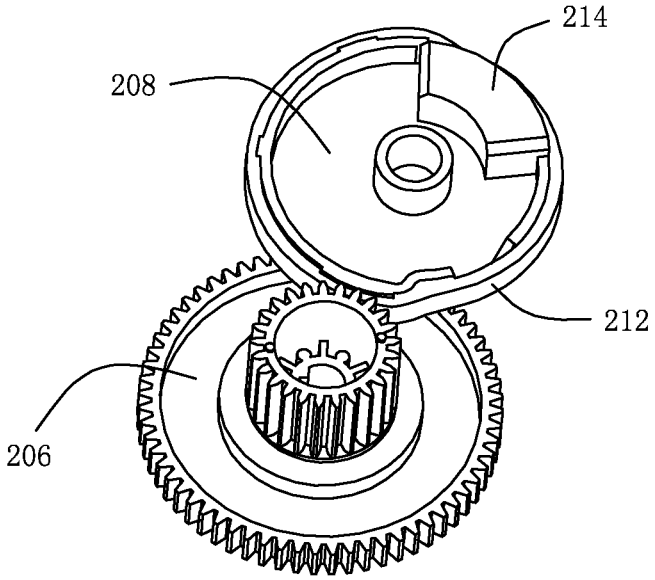
FIG. 10 is a perspective view of the developing cartridge for a laser printer of the present invention when the stirring wheel and the diameter-changing wheel are engaged.
Figure 11:
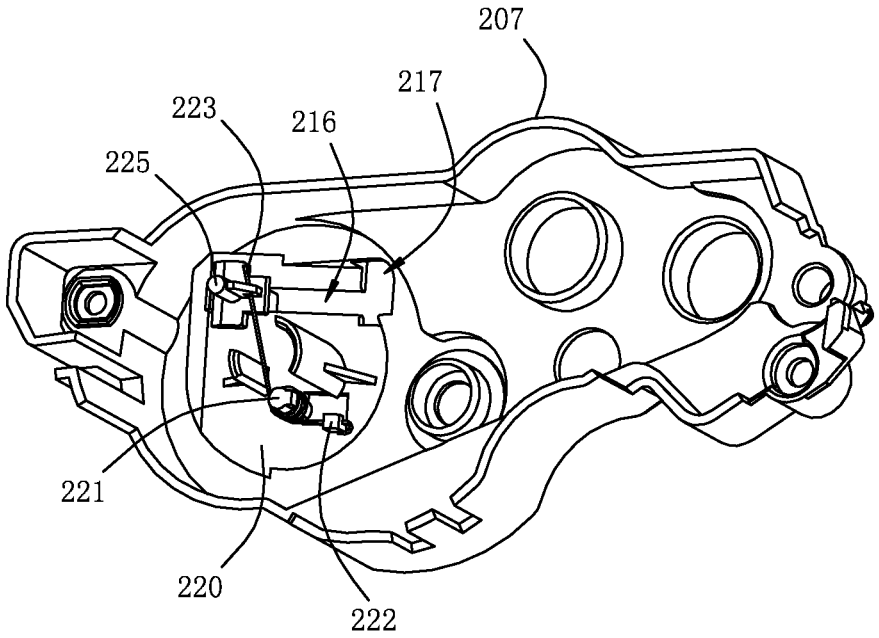
FIG. 11 is a perspective view of the developing cartridge for a laser printer of the present invention when the sliding block, the end cover, the return spring and the sliding groove are engaged.
Figure 12:
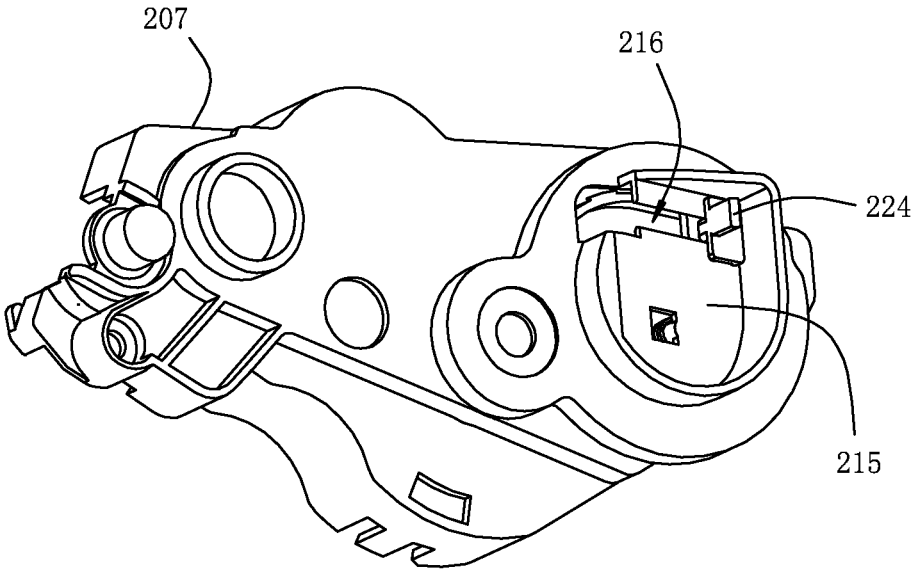
FIG. 12 is another perspective view of the developing cartridge for a laser printer of the present invention when the sliding block, the end cover, the return spring and the sliding groove are engaged.

See FIGS. 2 to 12, combined with FIG. 1, in a laser printer, the developing cartridge 200 bears the functions of storing toner and transporting the same to the surface of the photosensitive drum 101.

The constructing basis of the developing cartridge 200 is the tank 201, which is the basic frame of the developing cartridge 200.

On the tank 201, a hollow toner tank 202 is provided for storing toner. In the interior of the toner tank 202, a toner stirring rack (not shown) is provided for stirring toner, so that puffy toner enters a toner outlet (not shown in the Figures) inside the tank 201 of the toner tank 202, and then fills a hollow transition chamber (not shown in the Figures) inside the tank 201. A developing roller 105 is arranged at one side of the transition chamber, and is responsible for transporting the toner to the surface of the photosensitive drum 101 and for sealing the transition chamber as a chamber wall thereof. In the transition chamber, a transport roller (not shown in the Figures) is provided to transport the toner from the toner outlet to a position near the developing roller 105. The toner stirring rack, the transport roller and the developing roller 105 are in a state to rotate after receiving a torque, and keep a parallel relationship axially with respect to the tank 201. Each end of the toner stirring rack, the transport roller and the developing roller 105 in the axial direction extends beyond a sidewall 203 of the tank 201. At the axial ends of the toner stirring rack, the transport roller and the developing roller 105 extending beyond the sidewall 203, a stirring wheel 206, a first gear 204 and a second gear 205 are provided to receive a torque from other mechanisms, respectively. All of the stirring wheel 206, the first gear 204 and the second gear 205 are enclosed on the sidewall 203 by an end cover 207.

On the sidewall 203, a supporting shaft 209 is provided near the stirring wheel 206, and a diameter-changing wheel 208 is rotatably fitted over the supporting shaft 209. The diameter-changing wheel 208 is also enclosed on the sidewall 203 by the end cover 207. The diameter-changing wheel 208 and the stirring wheel 206 are axially parallel. The circumferential surface of the diameter-changing wheel 208 is provided as two sections of arcs 210, 211 of different diameters and these two arcs 210, 211 are connected in an end-to-end manner. The same elastic rubber ring 212 encloses the circumferential surfaces of the two sections of arcs 210, 211.

In the two sections of arcs 210, 211, the larger diameter arc 210 is meshed with the stirring wheel 206 at one end along the circumferential direction thereof via the elastic rubber ring 212. Specifically, the elastic rubber ring 212 is pressed between the gear teeth of the stirring wheel 206 and the larger diameter arc 210. A torque generated by the stirring wheel 206 can be transmitted to the larger diameter arc 210 via the elastic rubber ring 212, driving the diameter-changing wheel 208 to rotate. The smaller diameter arc 211 of the two sections of arcs 210, 211, after enclosed by the elastic rubber ring 212, still keeps a detached relation with the gear teeth of the stirring wheel 206.

On a lateral sidewall 213 of the diameter-changing wheel 208 at an axial side of the diameter-changing wheel 208 facing the end cover 207, a protruding block 214 is provided at a non-circle center position to extend towards the end cover 207 and axially along the diameter-changing wheel 208. The protruding block 214 has a predetermined circumference along the circumferential direction of the diameter-changing wheel 208.

After the diameter-changing wheel 208 is mounted to the sidewall 203, a part of the end cover 207 corresponding to the diameter-changing wheel 208 is provided as a planar inclined wall 215 in an inclined and intersecting relation with an axial direction of the diameter-changing wheel 208. A hollow sliding groove 216 is provided on the inclined wall 215, and has an inclination relative to the axial direction of the diameter-changing wheel 208 identical with the inclination between the inclined wall 215 and the axial direction of the diameter-changing wheel 208. When the end cover 207 is fixed on the sidewall 203, an end of the sliding groove 216 opposing the sidewall 203 is provided as a recess 217 having a width larger than that of the sliding groove 216. A sliding block 218 can be mounted in the sliding groove 216 via the recess 217. After the sliding block 218 is mounted in the sliding groove 216, the sliding block 218 can slide in the sliding groove 216. When the sliding block 218 is mounted in the sliding groove 216, when taking the inclined wall 215 as the boundary, an end of the sliding block 218 opposing the diameter-changing wheel 208 is in a free hanging state and is therefore called a free end 224, and an end adjacent the diameter-changing wheel 208 is called a working end 225, which is located in front of the protruding block 214 which moves circularly following the diameter-changing wheel 208, and extends to the base portion where the protruding block 214 is adjacent to the diameter-changing wheel 208 in the axial direction of the diameter-changing wheel 208.

The return spring is a torsion spring 219 for regulating a position of the sliding block 218 in the sliding groove 216. In an assembled stated, the spring body of the torsion spring 219 is fixed on an inner wall 220 of the end cover 207 facing the diameter-changing wheel 208. Specifically, the spring body of the torsion spring 219 is fixed on a protruding head 221 provided on the inner wall 220. One of the spring arms of the torsion spring 219 is fixed to a hook 222 provided on the inner wall 220, and another spring arm 223 thereof presses the sliding block 218 in the sliding groove 216 at one end close to the diameter-changing wheel 208.

When the developing cartridge 200 is installed into the laser printer and activated, the diameter-changing wheel 208 is driven to rotate by the stirring wheel 206 through a meshing relationship between the larger diameter arc 210 and the stirring wheel 206, whereupon the protruding block 214 on the diameter-changing wheel 208 is driven to move circularly. Then, the protruding block 214 presses the working end 225 of the sliding block 218 to drive the sliding block 218, causing the sliding block 218 to move along the sliding groove 216. When the sliding block 218 moves to a position where a pre-set detector (not shown in the Figures) of the laser printer is located, the detector is triggered to activate the detection mechanism of the laser printer. At last, detection that whether the developing cartridge 200 is a new product is finished.

When the sliding block 218 continues to move along the sliding groove 216 so that the protruding block 214 is detached from the working end 225 of the sliding block 218, the larger diameter arc 210 of the diameter-changing wheel 208 also moves to an end that is detached from the stirring wheel 206. Then, the smaller diameter arc 211 of the diameter-changing wheel 208 faces but does not contact the stirring wheel 206, allowing the diameter-changing wheel 208 to enter an idle state. The working end 225 of the sliding block 218, pressed by a second torsion arm 223 of the torsion spring 219, returns to its initial position, namely, the end of the sliding groove 216 adjacent to the diameter-changing wheel 208. After triggering the pre-set detector in the laser printer, the sliding block 218 enters an idle state.

INDUSTRIAL APPLICABILITY

Aiming at the problem that the detection performance is not stable due to easy damages of the detection gear of the developing cartridge when detecting whether the developing cartridge is a new product, the present invention provides a developing cartridge for a laser printer including an activation mechanism comprising a diameter-changing wheel, a return spring and a sliding block. When the activation mechanism functions, rotation is generated due to the stirring wheel by way of a meshing relationship between the larger diameter arc of the diameter-changing wheel and the stirring wheel, whereupon the protruding block on the diameter-changing wheel is driven to move circularly. Then, the protruding block drives the sliding block to move along the sliding groove. When the sliding block moves to a position where a pre-set detector of the laser printer is located, the detector is triggered to activate the detection mechanism of the laser printer. At last, detection that whether the developing cartridge is a new product is finished. When the sliding block continues to move along the sliding groove so that the protruding block is detached from the sliding block, the larger diameter arc of the diameter-changing wheel also moves to an end that is detached from the stirring wheel. Then, the smaller diameter arc of the diameter-changing wheel faces but does not contact the stirring wheel. The sliding block, pressed by the return spring, returns to its initial position. Using such a configuration, each component of the activation mechanism bears a single function respectively, thereby reducing the risk of damages.

The invention claimed is:

1. A developing cartridge for a laser printer, comprising a stirring wheel that is configured to receive a torque and transfer the same to a stirring rack and that is enclosed on an outer wall of a tank of the developing cartridge by an end cover, the developing cartridge being characterized by further comprising:

an activation mechanism comprising a diameter-changing wheel, a return spring and a sliding block, wherein the diameter-changing wheel is parallel with an axial direction of the stirring wheel and includes two sections of arcs of different diameters and these two arcs are connected with each other in an end-to-end manner, the larger diameter arc of the two sections of arcs is meshed with the stirring wheel at one end along the circumferential direction thereof, a protruding block is provided to axially face the end cover along the diameter-changing wheel at a non-circle center position facing a lateral end wall of the end cover at an axial side of the diameter-changing wheel, a part of the end cover corresponding to the diameter-changing wheel is provided as a planar inclined wall in an inclined and intersecting relation with an axial direction of the diameter-changing wheel, the inclined wall is provided with a sliding groove having the same inclination as that of the inclined wall relative to the axial direction of the diameter-changing wheel, the sliding block is slidably mounted in the sliding groove, the return spring presses the sliding block in the sliding groove at one end close to the diameter-changing wheel, an end of the sliding block opposing the diameter-changing wheel is in a free hanging state, and the end of the sliding block close to the diameter-changing wheel is located in front of the protruding block which moves circularly following the diameter-changing wheel, and extends to a base portion where the protruding block is adjacent to the diameter-changing wheel in the axial direction of the diameter-changing wheel.

2. The developing cartridge for a laser printer according to claim 1, wherein the return spring is fixed on an inner wall of the end cover facing the diameter-changing wheel.

3. The developing cartridge for a laser printer according to claim 2, wherein the return spring is a torsion spring, whose one torsion arm presses the sliding block in the sliding groove at one end close to the diameter-changing wheel.

4. The developing cartridge for a laser printer according to claim 1, wherein a circumferential surface of the larger diameter arc is covered with an elastic rubber ring, through which one end of the larger diameter arc is meshed with the stirring wheel along the circumferential direction of the larger diameter arc.

5. The developing cartridge for a laser printer according to claim 4, wherein the return spring is fixed on an inner wall of the end cover facing the diameter-changing wheel.

6. The developing cartridge for a laser printer according to claim 5, wherein the return spring is a torsion spring, whose one torsion arm presses the sliding block in the sliding groove at one end close to the diameter-changing wheel.

* * * * *